US005988055A

United States Patent [19]

Cramer

[11] Patent Number: 5,988,055

[45] Date of Patent: Nov. 23, 1999

[54] CALENDAR FOR PAPER AND SIMILAR WEB MATERIAL

[75] Inventor: Dirk Cramer, Duisburg, Germany

[73] Assignee: Voith Sulzer Finishing GmbH, Krefeld, Germany

[21] Appl. No.: 09/041,971

[22] Filed: Mar. 13, 1998

[30] Foreign Application Priority Data

Mar. 18, 1997 [DE] Germany ..... 197 11 241

[51] Int. Cl.[6] ..... D21G 1/00

[52] U.S. Cl. ..... 100/163; 100/170

[58] Field of Search ..... 100/47, 161, 162 R, 100/163 R, 163 A, 164, 165, 168–170

[56] References Cited

U.S. PATENT DOCUMENTS

| | | | |
|---|---|---|---|
| 509,930 | 12/1893 | Moore | 100/162 R |
| 3,369,483 | 2/1968 | Muller | 100/170 |
| 4,501,197 | 2/1985 | Karr et al. . | |
| 4,510,859 | 4/1985 | Berry . | |
| 4,890,551 | 1/1990 | Dahl et al. | 100/163 A |
| 5,704,285 | 1/1998 | Van Haag . | |

FOREIGN PATENT DOCUMENTS

| | | | |
|---|---|---|---|
| 0732443 | 9/1996 | European Pat. Off. . | |
| 16963 | 3/1882 | Germany . | |
| 2823738 | 11/1985 | Germany . | |
| 4231472 | 4/1993 | Germany . | |
| 29504034 | 6/1995 | Germany . | |
| 62-90394 | 4/1987 | Japan | 100/162 R |

*Primary Examiner*—Stephen F. Gerrity
*Attorney, Agent, or Firm*—Greenblum & Berstein, P.L.C.

[57] ABSTRACT

Calender for a material web that includes a roll stack having at least four rolls that includes an upper and a lower roll, a frame, and bearing blocks associated with the at least four rolls. The bearing blocks are movably coupled to the frame. The calender also includes a load device coupled to at least one of upper bearing blocks associated with the upper roll and lower bearing blocks associated with the lower roll, and tensile rods extending along and positioned on opposite ends of the roll stack. The tensile rods include upper and lower ends, the upper ends being coupled to one of the upper bearing blocks and the load device, and the lower ends being coupled to one of the lower bearing blocks and the load device.

24 Claims, 3 Drawing Sheets

CALENDAR FOR PAPER AND SIMILAR WEB MATERIAL

CROSS-REFERENCE TO RELATED APPLICATIONS

The present application claims priority under 35 U.S.C. § 119 of German Patent Application No. 197 11 241.2, filed Mar. 18, 1997, the disclosure of which is express incorporated by reference herein in its entirety.

BACKGROUND OF THE INVENTION

1. Scope of the Invention

The present invention relates to a calender for, e.g., paper and similar web material. The calender includes a roll stack having at least four rolls, bearing blocks, and a frame for retaining the bearing blocks. The bearing blocks are either affixed to the frame or mounted to the frame for vertical movement. The calender also includes a load device that acts on at least one of the bearing blocks of an upper roll, i.e., from above, and the bearing blocks of the lower roll, i.e., from below.

2. Discussion of Background Information

Multiple roll calenders of the type generally described above are known, e.g., German Patent No. DE 28 23 738 C2. The roll stack includes a number of rolls, e.g., 14. The roll stack is brought into an operating position via a lower load device and loaded via an upper load device with forces that, together with the weight of the rolls, exert a compressive strain in the roll nips. The lower load device supports itself on a base of the frame and the upper load device is supported on the top of the frame.

Recently, calenders having a number of rolls reduced to between five and eight rolls, see, e.g., German Patent Application No. DE-U-295 04 034, obtain a same glazing result as the prior art. However, in these devices, the roll temperatures are raised and the roll nips are subject to a heavier load, e.g., with a middle compressive strain in the lowest work nip of greater than 42 $N/mm^2$. As a result of these greater load forces, the calenders require more strongly dimensioned frames.

In two-roll-calenders, as discussed in, e.g., German Patent Application No. DE 42 31 472 A1, it is known to connect the bearing blocks of both rolls by incorporating the load device through tensile rods. In this manner, the frame may be dispensed with.

SUMMARY OF THE INVENTION

The present invention provides a multiple roll calender as generally discussed above which is also suitable for high loads.

The present invention includes tensile (tension) rods that run along both roll ends and along the roll stack. The tensile rod includes tensile ends that are coupled to a bearing block of the an upper roll or, preferably, with an upper load device and coupled to a bearing block of a lower roll or, preferably, with a lower load device.

In accordance with the arrangement of the present invention, the frame is not burdened by the tensile rods, and the forces applied by the load device are substantially absorbed by the tensile rods. The frame, which is utilized to hold the rolls in the stack, is primarily burdened with the weight of the rolls and further components. Further, the tensile rods can also be subsequently mounted with ease. Thus, the present invention enables retrofitting available frames for modem calenders to relieve the strain that arises in the prior art calenders. This retrofitting further enables the expenditures of time and money to be greatly reduced.

In accordance with the present invention, the tensile rods may be positioned to run or extend between the roll stack and the frame. As a rule, even with the prior art frames, there should be sufficient space for placing the tensile rods.

Further, a segment of the length of the tensile rods, e.g., a region where the bearing block is fixed to the frame, may also be mounted to the frame. Thus, a position of the tensile rod may be fixed on the frame without hindering operation of the calender. At least one end of the tensile rod is held free for the necessary expansion.

The present invention provides that the tensile rods may be located such that the upper tensile ends are retained on an upper end of the frame and that the lower tensile ends are suspended from the upper end. Since the tensile rods retain their vertical positioning as a result of their own weight, only simple measures are necessary to ensure the positioning of the tensile rods on the frame.

In accordance with the present invention, the bearing blocks of the upper roll and the upper tensile ends may be frame-mounted and the lower tensile ends may be coupled to a support block for the lower load device. In this manner, the lower load device may create the desired line load for the calender and may also enable an opening and/or adjustment of the roll nips.

The bearing blocks of the upper roll may be fixed to the frame and may include a mounting portion through which the tensile rod extends. In this manner, the mounting portion of the upper roll bearing blocks forms a support surface for a head section of the upper tensile end. Thus, the tensile rods are not directly coupled to the frame, but can also can be held by a frame-mounted bearing block.

In an alternative embodiment, the upper ends of the tensile rods may be coupled to the frame and may be positioned between the frame and the bearing blocks of the upper roll. In this manner, the tensile rods may be utilized as carriers of framemounted bearing blocks.

In another embodiment, the tensile rods may be provided with screw threads. Optionally, the screw threads may be internal screw threads. This arrangement enables the effective length of the tensile rods to be adjusted, if necessary. Further, in the event of a roll replacement or a roll reduction, a length modification of the tensile rod may be easily made.

In accordance with a particular embodiment of the present invention, the tensile rods may be formed by, e.g., discs that extend over a large portion of the height and width of the side panels of the frame. A disc of this type may be positioned directly adjacent the frame so as to takes up as little space as possible. This feature is particularly useful when utilizing modified frames. Further, relatively large cross-sections may be obtainable, even with thin discs, in particular due to the width of the frame side panels. Thus, tensile forces in the discs do not exceed safe limits. The tensile ends of the disc can also be implemented easily. In this manner, the upper tensile ends can be located between the frame and the bearing blocks of the upper roll and coupled securely to both. Furthermore, the lower tensile ends can be securely coupled to a support block supported by the lower load device.

An advantage of the present invention is that a vertical longitudinal groove of the support block accommodates the disc and a capping piece may partially penetrate a transverse groove in the support block and may partially penetrate a transverse groove in the disc. Thus, only minor alterations and additions to the available components are hereby necessary to subsequently equip a calender with tensile rods.

Furthermore, it is advantageous that the tensile rods are guided through mountings on the frame. Thus, these mountings permit a movement of the tensile rods for expansion but should, however, hinder a buckling.

In a preferred embodiment of the present invention, the mountings may be formed by rear projection mountings coupled to, and extending from, the tensile rods to clasp into available guideways of the frame. Further, other design features may also come into consideration, e.g., clasps that encompass the frame and the tensile rod.

In another advantageous feature of the present invention, the roll stack may be formed with hard and soft rolls, the soft rolls including a synthetic elastic covering. Since synthetic coverings of this type generally require only minimum abrasion, tensile rods without longitudinal adjustment can be used, e.g., the above-mentioned discs.

The present invention is directed to calender for a material web that includes a roll stack having at least four rolls that includes an upper and a lower roll, a frame, and bearing blocks associated with the at least four rolls. The bearing blocks are movably coupled to the frame. The calender also includes a load device coupled to at least one of upper bearing blocks associated with the upper roll and lower bearing blocks associated with the lower roll, and tensile rods extending along and positioned on opposite ends of the roll stack. The tensile rods include upper and lower ends, the upper ends being coupled to one of the upper bearing blocks and the load device, and the lower ends being coupled to one of the lower bearing blocks and the load device.

In accordance with another feature of the present invention, the tensile rods may be located between the roll stack and the frame.

In accordance with another feature of the present invention, the tensile rods include a segment that is coupled to the frame via one of the upper and lower bearing blocks.

In accordance with still another feature of the present invention, the upper ends are coupled to the frame and the lower ends are suspended to hang from the frame.

In accordance with another feature of the present invention, the load device includes a support block and the upper bearing blocks and the upper ends are coupled to the frame and the lower ends are coupled to the support block.

In accordance with a further feature of the present invention, the upper bearing blocks are coupled to the frame and include a mounting bracket through which the tensile rod extends. The upper end includes a head for retaining the tensile rod in the mounting bracket.

In accordance with a still further feature of the present invention, the upper ends are coupled to the frame and, on a side of the tensile rods opposite the frame, to the upper bearing blocks.

In accordance with still another feature of the present invention, the tensile rods include at least a threaded portion. Further, the threaded portion may include internal screw threads.

In accordance with another feature of the present invention, the tensile rods are composed of rectangular bars that extend substantially along a height and a width of side panels of the frame. Further, the loading device includes a support block having a vertical, longitudinal groove that receives the rectangular bar. The rectangular bar includes a transverse groove and the loading device further includes a block that partially penetrates a transverse groove in the lower bearing block and that partially penetrates a transverse groove in the rectangular bar.

In accordance with a further feature of the present invention, the calender also including mounting brackets coupled to the frame and the tensile rods extending through the mounting brackets. Further, the mounting brackets include rear projection tabs to be clasped into guideways of the frame.

In accordance with still another feature of the present invention, the roll stack is composed of hard and soft rolls. The soft roll including a synthetic elastic covering.

The present invention is directed to a calender for a material web that includes a roll stack having a plurality of rolls including an upper roll, a lower roll, and at least one intermediate roll, a frame, at least one upper bearing block associated with the upper roll and at least one lower bearing block associated with the lower roll, the upper and lower bearing blocks being coupled to the frame, tensile rods extending parallel to the roll stack and positioned on opposite ends of the rolls, and a load device coupled to a first end of the tensile rods and one of the upper and lower bearing blocks being coupled to a second end of the tensile rods.

In accordance with another feature of the present invention, the one bearing blocks coupled to the second end include a portion for receiving a roll pin, a mounting bracket through which the second end extends, and a coupling unit to couple the one bearing blocks to the frame.

In accordance with another feature of the present invention, the load device including a hydraulic cylinder-piston arrangement to exert a force on the roll stack and in press nips formed between adjacent rolls.

In accordance with still another feature of the present invention, the load device includes a support block that includes a mounting bracket, the second end of the tensile rods being coupled to the mounting bracket. Further, the tensile rods have a transverse groove and the mounting bracket includes a groove through which the grooved portion of the tensile rods extend. Still further, the calender may include a block which is partially located within the transverse groove in the tensile rods and which is partially located in a transverse groove in the mounting bracket. The tensile rods may be composed of rectangular bars.

In accordance with a further feature of the present invention, the support block is coupled to a guideway of the frame.

In accordance with yet another feature of the present invention, the upper bearing blocks are rigidly affixed to the frame and the lower bearing blocks are slidably coupled to the frame.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
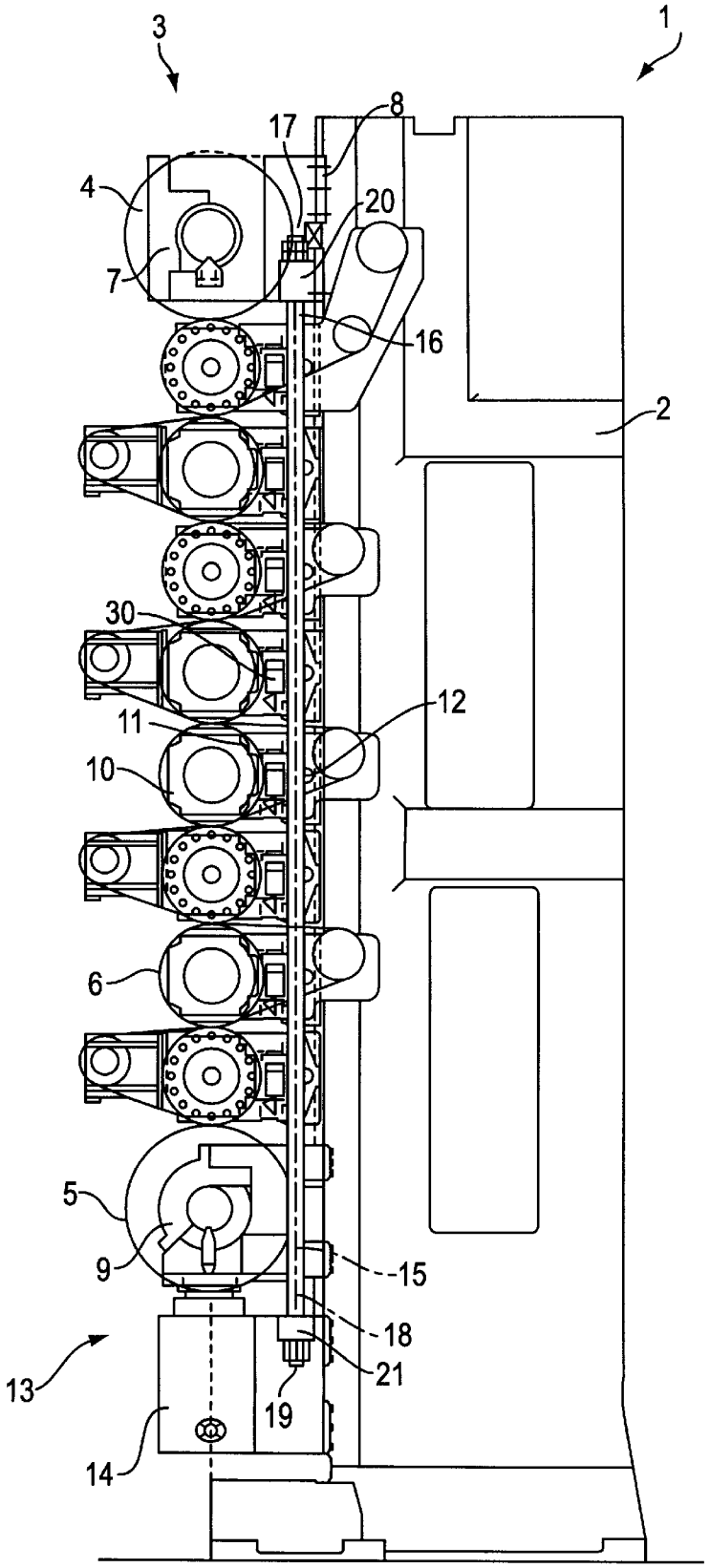
FIG. 1 illustrates a schematic lateral view of a multiple-roll calender in accordance with the present invention.
Figure 2:
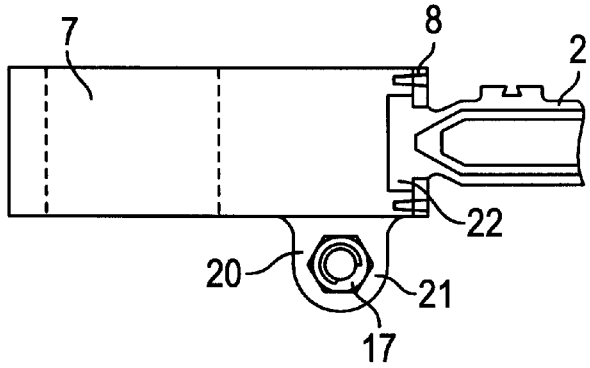
FIG. 2 illustrates a partial top-view of the calender depicted in FIG. 1.

A multiple roll calender 1, as illustrated in FIGS. 1 and 2, includes a frame 2. The noted illustrations depict a view of a side panel of frame 2. A roll stack 3 includes an upper roll 4, a lower roll 5, and a number of intermediate rolls 6, e.g., eight intermediate rolls, located therebetween. However, it is noted that the number of rolls in the stack can be greater than ten, and, alternatively, less than ten. Some of intermediate rolls 6, e.g., the third, fifth, sixth and eighth rolls (with respect to the stack of ten rolls) of stack 3 may be provided with an elastic covering, e.g., synthetic elastic. The rolls are mounted or held on both ends, each by bearing blocks 7, 9, and 10. Bearing blocks 7 associated with upper roll 4 may be coupled to an upper end of frame 2, e.g., via screws and clasp strips. Bearing blocks 9 associated with lower roll 5 may be retained or positioned in a vertically slidable position on frame 2. Bearing blocks 10 of intermediate rolls 6 may each be coupled to a fixed rotation point 12 on frame 2 via a lever 11. A load device 13 that includes a support block 14 is positioned on both roll ends, e.g., at the bottom of roll stack 3. Load device 13 may also include hydraulic piston-cylinder-units to push lower roll 5 and intermediate rolls 6 upward against upper roll 4. In this manner, pressure is exerted in the roll nips (openings) formed between adjacent rolls.

A tensile rod 15 may be located on both roll ends and positioned between roll stack 3 and frame 1. Tensile rod 15, which may be in the form of a rod, may be provided with threaded ends. In this manner, a head 17 may be coupled to an upper tensile end 16 of tensile rod 15, and a head 19 may be coupled to a lower tensile end 18 of tensile rod 15. The rod-shaped tensile rod 15 extends through a mounting bracket 20 coupled to bearing block 7. Thus, an upper side of mounting bracket 20 forms a support surface for head 17 to couple upper end 16 of tensile rod 15 to frame 2. The remaining portion of tensile rod 15 may hang down freely and extend through a bracket 21 and be coupled with head 19. Thus, a lower side of mounting bracket 21 forms a support surface for head 19 to couple lower end 16 of tensile rod 15 to frame 2. In this manner, if an upwardly directed pressure is exerted via load device 13 on roll stack 3, the tensile rods will absorb substantially all of the loading forces. Further, support block 14 may be vertically positionable on a traditional guidance mechanism 22 of frame 2. In this manner, tensile rods 15 retain their vertical positioning under all operating conditions.

As noted above, because substantially all loading forces exerted on roll stack 3 may be absorbed by tensile rod 15, frame 2 is substantially unaffected by the strain. Thus, it is only necessary that frame 2 bear or absorb the weight of roll stack 3, load device 13, and tensile rod 15. Accordingly, very high line loads can thus be obtained without excessively loading frame 2.

Figure 4:
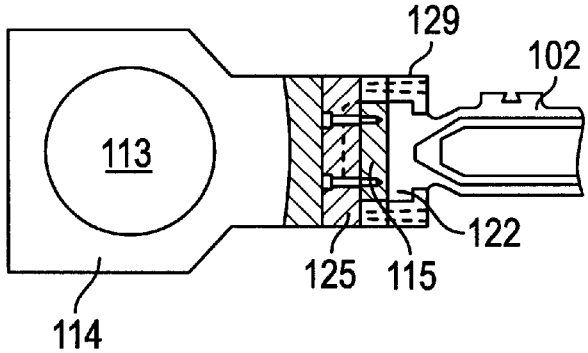
FIG. 4 illustrates a sectional view along a line 4—4 shown in FIG. 3.
Figure 5:
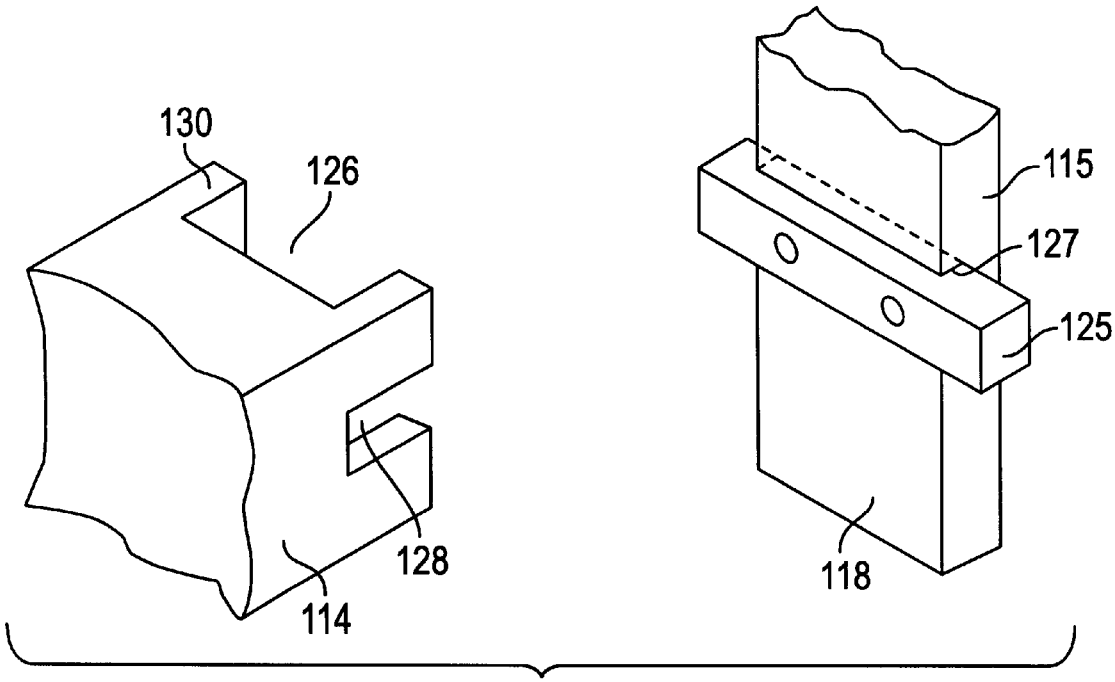
FIG. 5 illustrates perspective view of a lower tensile end of a disc-shaped tensile rod.
Figure 3:
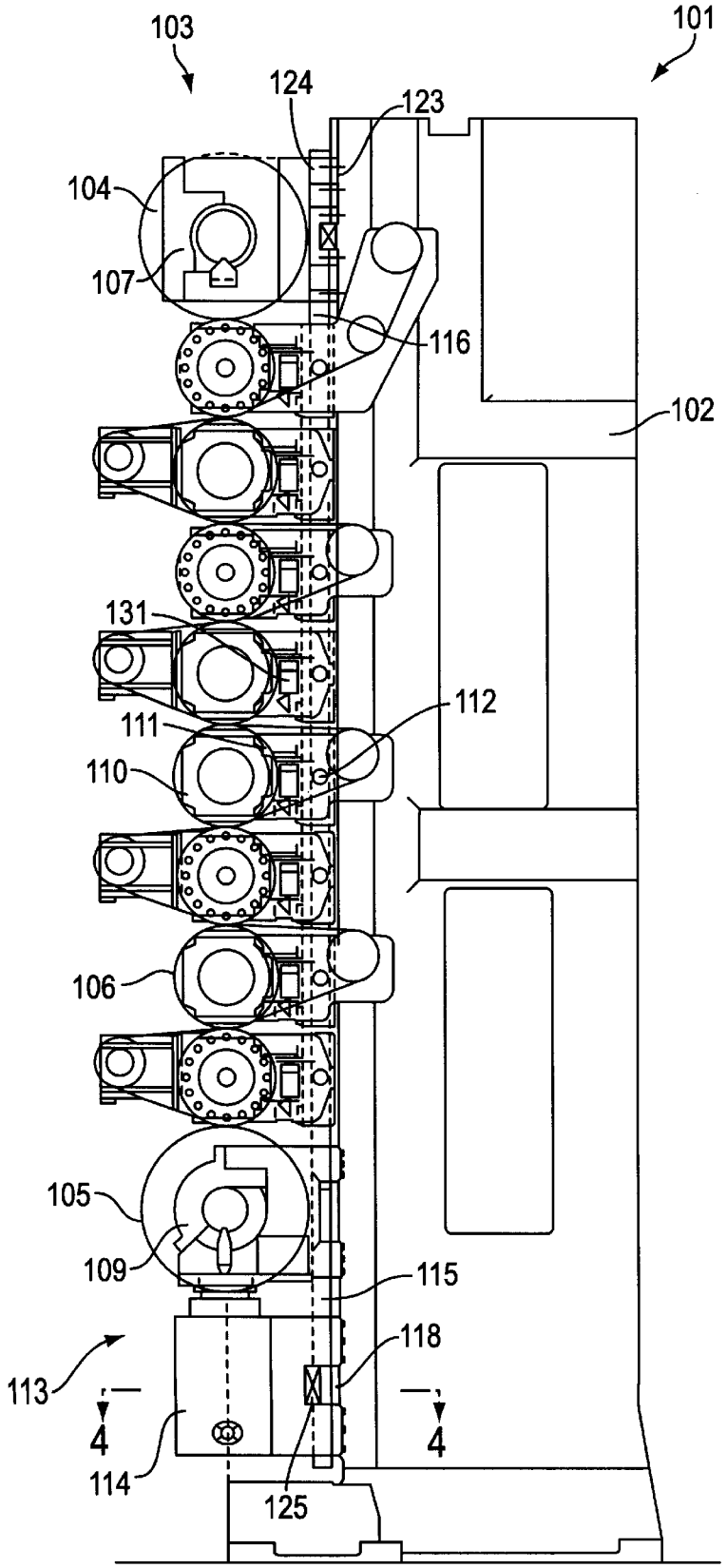
FIG. 3 illustrates a schematic lateral view of a second embodiment of the present invention.

In an alternative embodiment of the present invention illustrated in FIG. 3, reference numerals corresponding to those depicted in FIG. 1 have been increased by 100. The most distinguishing aspect between FIGS. 1 and 3 is that tensile rods 115 have a shape of a disc or rectangular bar, and extend over a large part of the height of frame 102 and over a large part of the width of side panels of frame 102. Upper tensile end 116 may be coupled, e.g., with screws 123 to upper end 108 of frame 102, while the remaining part of tensile rod 115 hangs freely downward. On the side of tensile rod 115 opposite frame 102, bearing block 107 of upper roll 104 may be coupled, e.g., with screws 124, to tensile rod 115. Lower tensile end 118 may be coupled to bearing block 114 via a block 125, shown in greater detail in FIGS. 4 and 5. Tensile rod 115 may extend through a longitudinal groove 126 of bearing block 114, and block 125 may extend partially through a transverse groove 127 in tensile rod 115 and partially through a transverse groove 128 in bearing block 114.

Mounting tabs 129 may be formed by rear projection mountings that may be provided on projections 130 of bearing block 114 to overlap the conventional guideway 122 of frame 102. Mountings tabs 129 give tensile rod 115 so much clearance that it can expand freely when burdened (loaded).

FIGS. 1 and 3 also illustrate compensation devices 30 and 131, respectively, that can affect levers 11 or 111. In this regard, the projecting weights of the rolls can be compensated and the weight forces from the stack may be transferred to the frame.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A calendar for a material web comprising:

a roll stack having opposite ends having at least four rolls that include an upper end roll and a lower end roll;

a frame having an upper end and a lower end:

bearing blocks associated with the at least four rolls, the bearing blocks of one of the upper end roll and the lower end roll being fixed to one of the upper end of the frame and the lower end of the frame and the bearing blocks of the other rolls being movable coupled to the frame;

at least one load device, each of said at least one load device comprosing a support block fixed to one of the upper end of the frame and the lower end of the frame, the one end being different from the one end fixed to the bearing blocks, and a movable part coupled to the bearing block associated with the other end roll;

tensile rods extending along and positioned on the opposite ends of the roll stack;

the tensile rods including upper and lower ends, on edn of each tensile rold being coupled to one of the bearing blocks associated with one of the upper and lower end rolls, and the other end of the tensile rod being coupled to one of the support blocks.

2. The calender in accordance with claim 1, the tensile rods being located between the roll stack and the frame.

3. The calendar in accoradance with claim 1, each of the tensile rods including a segment that is coupled to the frame via one of the bearing blocks and support blocks.

4. The calendar in accordance with claim 1, the bearing blocks being coupled to the frame and including a mounting bracket through which the tensile rod extends; and the upper end of the tensile rod including a head for retaining the tensile rod in the mounting bracket.

5. The calendar in accordance with claim 1, the upper ends of the tensile rods being coupled to the frame and, on a side of the tensile rods opposite the frame, to the bearing blocks.

6. The calendar in accordance with claim 1, the tensile rods comprising at least a threaded portion.

7. The calender in accordance with claim 6, the threaded portion comprising internal screw threads.

8. The calendar in accordance with the claim 1, further comprising mounting brackets coupled to the frame; and the tensile rods extending through the mounting brackets.

9. The calendar in accordance with claim 8, the frame including guideways and the mounting brackets comprising rear projection tabs to be clasped into the guideways.

10. The calendar in accordance with claim 1, the roll stack comprising hard and soft rolls; and the soft roll including a synthetic elastic covering.

11. A calendar for a material web comprising:

a roll stack including opposite ends and including at least four rolls that include an upper and a lower end roll;

a frame having an upper end and lower end;

bearing blocks associated with the at least four rolls, the bearing blocks of one end roll being fixed to the frame at one end thereof and the bearing blocks of the other rolls being movable coupled to the frame;

at least one load device, each of said at least one load device includes a support block fixed to the other end of the frame and a movable part coupled to the bearing block assocated with the other end roll;

tensile rods extending along and positioned on the opposite ends of the roll stack;

the tensile rods including upper and lower ends, one end of each tensile rod being coupled to one of the bearing blocks associated with one of the end rolls, and the other end of tensile rod being coupled to one of the support blocks;

the tensile rods being configured as rectangular bars that eaxtend substantially along a height and a width of side panels of the frame.

12. The calendar in accordance with claim 11, the support block having vertical, longitudinal groove that receive the rectangular bar;

the rectangular bar including a trasnverse groove; and each of the at least one load device further comprising a block that partially penetrates a transverse groove in the lower bearing block and that partially penetrates a transverse groove in the rectangular bar.

13. A calendar for material web comprising:

a roll stack having opposite ends and having a plurality of rolls inluding a top end roll, a bottom end roll, and at least one intermidiate roll;

a frame having an upper end and a lower end;

bearing blocks, at least one of the bearing blocks being coupled to one end of the frame and being associated with one of the top end roll and the bottom end roll;

at least one load device, each of said at least one load device includes a support block coupled to the other end of the frame, the other end being opposite the at least one bearing block, and a movable part coupled to the at least one bearing block;

tensile rods including a first end and a second end, the tensile rods extending parallel to the roll stack and positioned adjacent the top end roll and the bottom end roll; and the first end of the tensile rod being coupled to the at least one bearing block associated with one of the top end roll and the bottom end roll and the second end of the tensile rod being coupled to the support block.

14. The calendar in accordance with claim 13, the one bearing blocks coupled to the second end comprising a portion for receiving a roll pin, a mounting bracket through which the second end extends, and a coupling unit to couple the one bearing blocks to the frame.

15. The calendar in accordnace with claim 13, the load device comprising a hydraulic cylinder-piston arrangement to exert a force on the roll stack and in press nips formed between adjacent rolls.

16. The calendar in accordance with claim 13, the support block including a mounting bracket, the second end of the tensile rods being coupled to the mounting bracket.

17. The calender in accordance with claim 16, the tensile rods having a transverse groove; and the mounting bracket comprising a groove through which the grooved portion of the tensile rods extend.

18. The calendar in accordance with claim 17, further comprising a block which is partially located within the transverse groove in the tensile rods and which is partially located in a transverse groove in the mounting bracket.

19. The calender in accordance with claim 18, the tensile rods being composed of rectangular bars.

20. The calendar in accordance with claim 16, the frame including a guideway and the support block being coupled to the guideway.

21. The calendar in accordance with claim 13, at least one of the bearing blocks being rigidly affixed to the frame; and at least one of the bearing blocks being slidably coupled to the frame.

22. A calendar for a material web comprising:

a roll stack having opposite ends having a plurality of rolls including an upper end roll, a lower end roll, and at least one intermediate roll;

a frame having an upper end and a lower end;

bearing blocks, at least one of the bearing blocks being coupled to one end of the frame and being associated with one of the upper end roll and the lower end roll;

load devices wherein each load device includes a support block coupled to one of the upper end and the lower end of the frame, and a movable part coupled to the bearing block associated with the other end of the frame, tensile rods including a first end and a second end and having a transverse groove, the tensile rods extending parallel to the roll stack and positioned adjacent the upper end roll and the lower end roll, the first end of the tensile rod being coupled to the at least one bearing block assocated with one of the upper end roll and the lower end roll and second end of the tensile rod being coupled to the support block, the support block including a mounting bracket, the second end of the tensile rods being coupled to the mounting bracket; and the mounting bracket comprising a groove through which the transverse groove of the tensile rods extend.

23. The calendar in accordance with claim 22, further comprising a block which is partially located within the transverse groove in the tensile rods and which is partially located in a trasverse groove in the mounting bracket.

24. The calendar in accordnace with claim 23, the tensile rods being composed of rectangular bars.

* * * * *